United States Patent [19]

Bowker

[11] 3,931,498

[45] Jan. 6, 1976

[54] CUTOFF SAW

[75] Inventor: John F. Bowker, Edmonds, Wash.

[73] Assignee: The Black Clawson Company, Middletown, Ohio

[22] Filed: Apr. 19, 1972

[21] Appl. No.: 245,297

[52] U.S. Cl...... 235/92 DN; 235/92 DM; 235/92 R

[51] Int. Cl.[2]..... G06M 7/00; G06M 3/02

[58] Field of Search..... 235/92 FL, 92 WT, 92 PS, 235/92 DM, 92 DN

[56] References Cited

UNITED STATES PATENTS

| | | | |
|---|---|---|---|
| 3,549,870 | 12/1970 | Lay | 235/92 PL |
| 3,562,498 | 2/1971 | Darling | 235/92 PS |
| 3,666,928 | 5/1972 | Burke | 235/92 FL |
| 3,678,253 | 7/1972 | Johnston | 235/92 FL |

*Primary Examiner*—Joseph M. Thesz, Jr.
*Attorney, Agent, or Firm*—Biebel, French & Bugg

[57] ABSTRACT

Logs which are to be divided into standard length blocks are first measured and their total length is displayed visually on an electronic readout device. Based on this length measurement, an operator selects one of several standard lengths and causes the log to advance relative to a cutoff saw where it is then cut. Total length measurement is determined by presetting a counter with a count representing maximum possible log length, down counting the counter when the trailing edge is detected and stopping the count when the leading edge reaches a reference position. Movement of the log is obtained from a tachometer generator mounted to rotate with a conveyor drive and an electronic circuit converts the output of the tachometer generator into pulses each representing a predetermined and convenient unit of length measurement.

2 Claims, 4 Drawing Figures

DR
TACH
LENGTH READOUT
LENGTH COUNTER
"M"
UP-DOWN TACH PRE SCALER
GATE
LENGTH COUNTER UP-DOWN
"N"
MAX LENGTH ROM
PULSE GEN
RUN FF
QUAD TACH GEN
RUN RELAY
SLOW RELAY
K1
K2
STOP
WORK COUNTER (UP-DOWN)
PULSE GEN.
OVER TRAVEL ROM
BLOCK MEASUREMENT VARIABLE

CUTOFF SAW

BACKGROUND OF THE INVENTION

This invention relates to a conveyor control for advancing logs past a saw where they may be cut into smaller, selected lengths. There is an optimum combination of standard length blocks available from a log of a given length, and in order to maximize the volume of good wood which may be obtained from any given log, the operator must know its length accurately so he can choose the proper combination of smaller, standard lengths into which it is to be cut.

SUMMARY OF THE INVENTION

This invention relates to a device which displays visually the length of each log approaching a cutoff saw to provide the operator with information regarding the total length of the log, or the length of the log remaining after it has been cut.

A length counter is preset to a value slightly larger than the maximum length of the log which may be accommodated on the conveyor as a conveyor chair, representing the trailing edge of the log, passes a detector. The length counter is then down-counted until the leading edge of the log is detected by a stop detector. The stop detector is located a fixed distance from the cutoff saw, and therefore this invention provides for continuing to move the conveyor through this distance and then to stop it with the leading edge of the log in line with the saw.

In the preferred embodiment of the invention, the operator may then select one of three preset log lengths and cause the log to advance automatically relative to the saw by the selected preset length. As the log moves, the total length counter continues to display the length of the log which remains ahead of the saw.

The movement of the log is measured by means of a tachometer generator connected to the log conveyor. One unique feature of the invention is the use of a tachometer prescaler circuit which enables the output pulses supplied to the length counter to be adjusted to represent practically any preselected interval, regardless of the spacing of the pulse output from the tachometer generator. This enables the length measuring device to be installed on existing conveyor systems without extensive modification since the tachometer generator output may be modified to provide distances of movement of the log in terms of conventional units of length measurement by electronic means.

The tachometer prescaler circuit operates by multiplying the output of the tachometer or shaft encoder by an adjustable preset number (M) and dividing the result by another adjustable preset number (N). Therefore, the output frequency of the tachometer is in effect multiplied by M/N to provide the desired output. The tachometer has a quadrature output which enables the prescaler circuit to determine direction of rotation and to take this into account when generating output pulses.

Accordingly, it is an object of this invention to provide an improved control system for moving logs by a conveyor past a cutoff saw in which the total length of the log remaining is displayed visually by electro-optic devices and in which the operator may select one of several preset lengths to advance the log relative to the saw; to provide an improved electronic circuit for use with the conveyor system described above in which the length of the log ahead of the cutoff saw is displayed, continuously regardless of direction of travel of the conveyor; and to provide an improved electronic circuit which calibrates the output from a tachometer generator into pulses representing standard units of length measurement, regardless of the direction of rotation of the tachometer.

Other objects and advantages of the invention will be apparent from the following description, the accompanying drawings and the appended claims.

DESCRIPTION OF THE PREFERRED EMBODIMENT

Figures 1, 2:
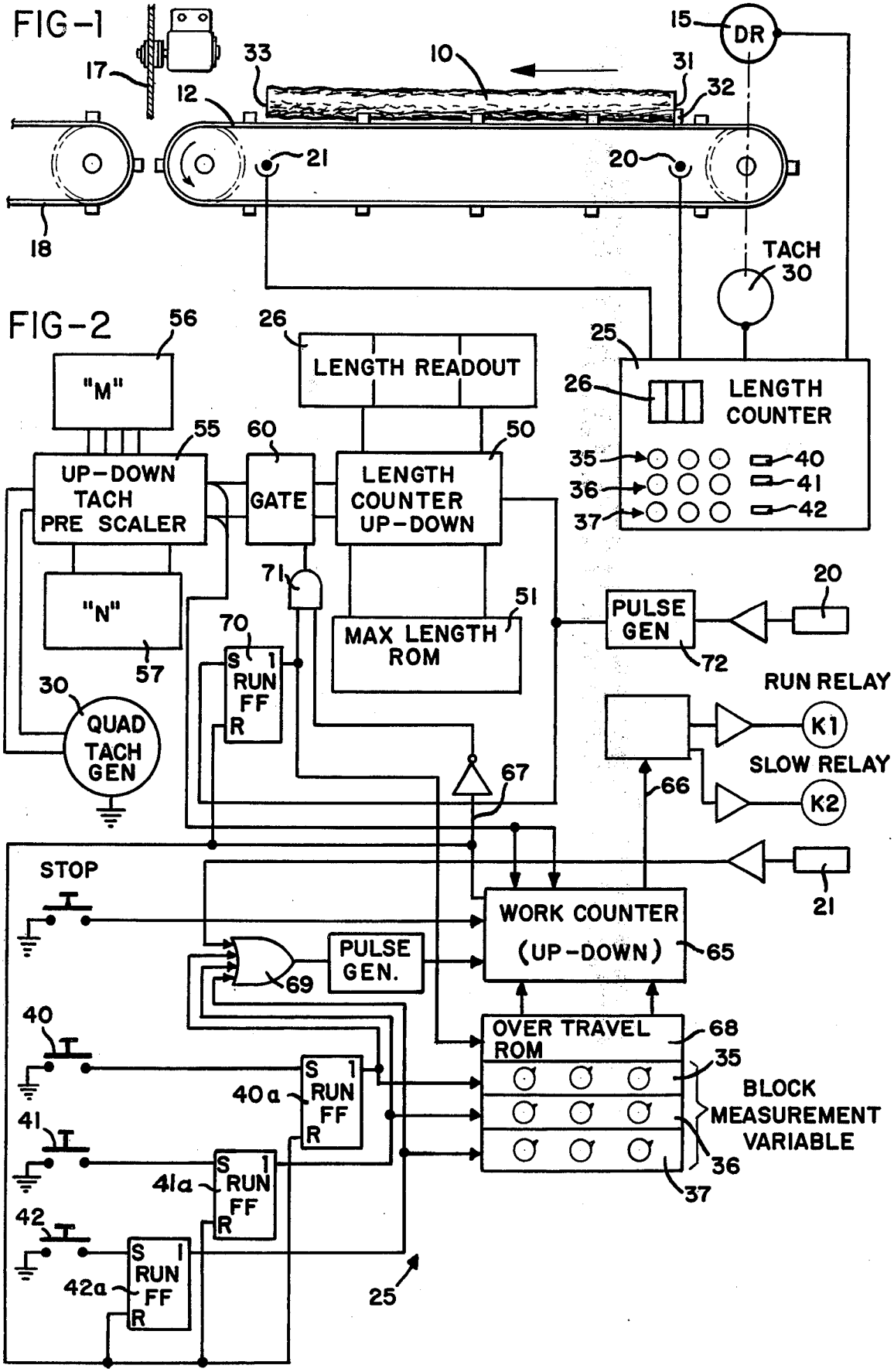
FIG. 1 is a view showing the log conveyor and a block diagram of the control circuitry.
FIG. 2 is a block diagram of the control circuitry.

Referring now to the drawings which show a preferred embodiment of this invention, and particularly to FIG. 1, a log 10 is moved by means of a conveyor 12 driven by a motor 15. A manually positionable saw 17, mounted at the end of the conveyor 12, may be used to cut the log 10 into any length selected by an operator. A second conveyor 18 removes the sawn log blocks or sections.

Log length measurement is determined by establishing a fixed distance between a first detector 20 and a second detector 21. This distance is greater than the length of the logs carried by the conveyor 12. The electronic control circuit, shown generally at 25, includes a readout device 26 which initially displays the distance between the two detectors, as prerecorded in a length counter. A shaft encoder or tachometer 30, connected to the conveyor 12, supplies pulses representing movement to the circuit 25, and these pulses cause the length counter to down-count when the trailing edge 31 of the log, as represented by a conveyor chair 32, passes the first detector 20. This will continue until the leading edge 33 of the log is detected by the second detector 21. Thus, the longer the log, the fewer the pulses supplied to down-count the length counter. The conveyor then moves the log the distance between the detector 21 and the saw 17 where it is stopped. During this movement, the length counter remains unchanged.

By knowing the total length of the log, the operator can then cut the log into several shorter, standard length sections or blocks and thus obtain maximum yield from each log. In the embodiment shown, the operator may select one of three preset lengths, and then cause the log 10 to advance that preset distance and stop so that the operator can thereafter cause the saw 17 to cut the log. To accomplish this, the operator has three sets of dials 35, 36 and 37 into which he may preset the length he wishes the log to travel before stopping. Selection of one of these preset distances may be made by depressing one of the switches 40–42.

Referring now to FIG. 2 which is a block diagram of the control circuit 25, the length readout device 26 is connected directly to the output of a length counter 50. This counter is an up-down type of counter which may be preset from a read-only-memory 51 to a length value which represents the distance between detectors 20 and 21, or the maximum length of log which may be accepted by the device. Upon initiation of the counting sequence by the detector 20, the length counter will begin downcounting from the preset value until the leading edge 33 is detected by detector 21. The count then remaining in the length counter 50, as displayed on the readout device 26, represents the initial length of the log.

The counter 50 down-counts due to movement of the conveyor 12 in the direction of the arrow in FIG. 1, as represented by pulses generated by the tachometer generator 30. The output of the tachometer 30 is received by a tachometer prescaler circuit 55 which, as has been explained, modifies the pulse output of the tachometer generator by the ratio M/N. The number M is supplied by a first or M counter 56 and the number N is supplied by a second or N counter 57. The output of the prescaler, which now represents accurate, and convenient increments of length, are then directed to the length counter 50 through a gate 60. The output of the tachometer prescaler 55 is also supplied to a work counter 65.

The work counter 65 controls the operation of the conveyor drive motor 15 through two outputs, 66 and 67, which control relays connected to the drive motor. Relay K1 is energized whenever the work counter includes a number greater than zero, and is deenergized at a preset number, determined by control circuit 65*a*. Relay K2 is energized whenever the work counter approaches its zero condition to cause the motor to run at the slower speed and is deenergized at a preset number determined by control circuit 65*a*.

The work counter 65 may be preset with a number representing the distance from the detector 21 to the plane of the saw 17 from an overtravel read-only-memory (ROM) 68, and this is accomplished when the leading edge 33 of the log is detected by the detector 21. Thereafter, the work counter will be conditioned to a count as contained in one of the three preset circuits 35–37 which, as explained before, may be manually adjusted by the operator. The count from one of these circuits is loaded into the work counter 65 by the operator by closing one of switches 40–42 which sets a corresponding flip-flop 40*a*–42*a*. These flip-flops are connected both to the preset circuits 35–37 and to OR gate 69 which causes one of the memories to be loaded into the work counter 65. OR gate 69 also receives an output from the detector 21 to cause the overtravel memory 68 to be read into the work counter upon the initiation of the measuring sequence.

Once a length is loaded into the work counter 68, the run relay K1 will energize to cause the conveyor to move the log until the work counter has been counted down to zero. Immediately prior to the zero count, relay K2 will cause the conveyor to slow so that the log will not overshoot the saw.

Thus, the operator may place several preset lengths into the preset circuits 35–37 and cause one to be selectively entered into the work counter 65 by operation of one of the switches 40–42. The log will then advance a distance equal to that which was preset. Since the length counter 50 is active in the circuit at all times, the readout device 26 will indicate the length of the log which remains after each cut.

In the event that the operator desires to reverse the travel of the conveyor, he may do so and retain an indication on the readout device 26 of the length of the log which remains ahead of the saw. This is accomplished by using up-down counters for both the length counter 50 and the work counter 65, and by providing a tachometer generator 30 which provides not only pulses representing distance of movement but also an output signal which represents the direction of movement.

Upon the detection of the trailing edge of the log by the photodetector 20, an output is supplied to a pulse generator or pulse forming circuit 72, the output of which causes the maximum length memory 51 to load the length counter 50 to the maximum length distance. At the same time, flip-flop 70 is is set and allows pulses to pass through gate 60 to count down the length counter 50. Also, the output of the flip-flop 70 is applied to energize the overtravel memory 68 and allow that memory to be loaded into the work counter 65 so that the drive motor will continue to move the log the distance between the detector 21 and the saw 17 after the detector 21 senses the leading edge of the log. Flip-flop 70 is reset when the work counter 65 obtains the count of all zeros. Thereafter, gate 60 is enabled through OR gate 71 by a signal on line 67 which is preset each time the work counter has set into it a length from one of the preset memories 35–37.

Figure 3A:
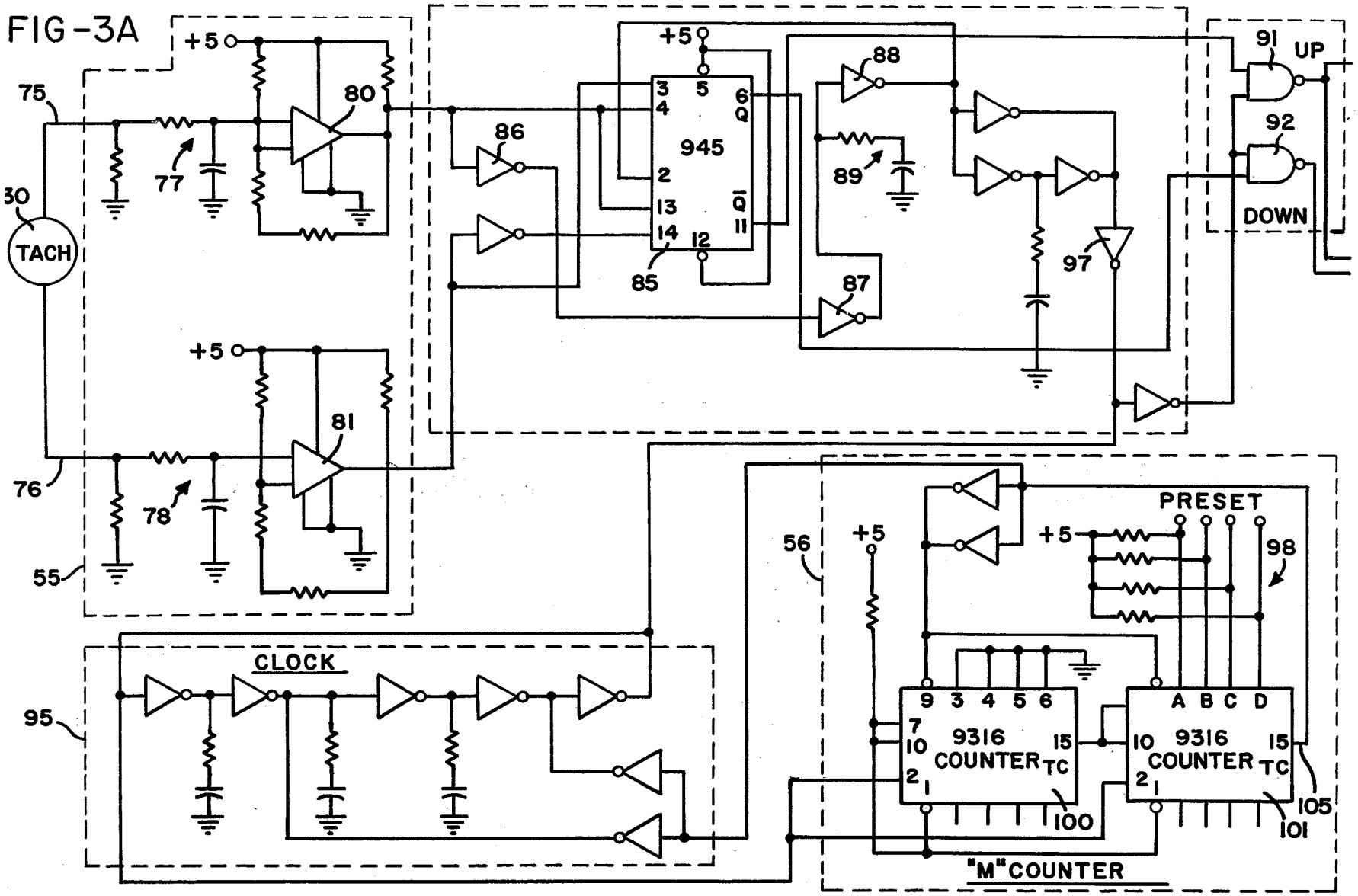
FIG. 3A and 3B together are an electrical schematic diagram of the tachometer prescaler circuit.
Figure 3B:
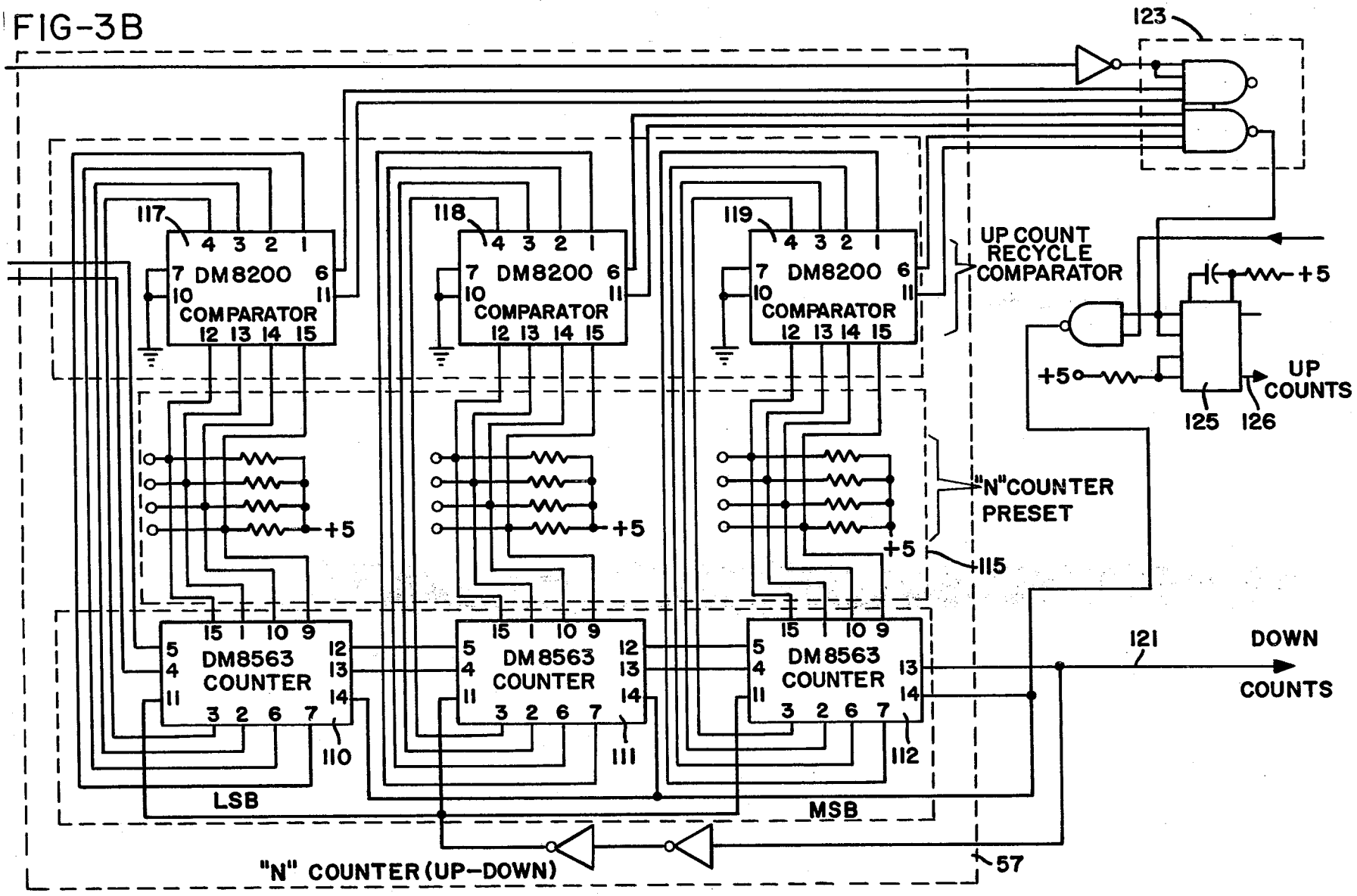

Referring now to the prescaler circuit shown in FIGS. 3A and 3B, the tachometer generator 30 is a quadrature output shaft encoder having two outputs 75 and 76 which are directed through RC filters 77 and 78 to quantitizing amplifiers 80 and 81, the outputs of which are applied to flip-flop 85. Output 76 is used to steer the input of the flip-flop 85 to receive the pulse from line 75. In the embodiment shown, flip-flop 85 is a National Semiconductor Corp. type DM945 J-K flip-flop.

A delay network including inverters 86, 87 and 88 and RC network 89 is used to insure that the flip-flop inputs are enabled immediately prior to the transition of the signal on line 75. This prevents entry of erroneous information while the output of 75 is high.

The direction of rotation of the tachometer generator 30 will cause either the Q or $\overline{Q}$ output of flip-flop 85 to be high, which will direct the M pulses from counter 56 through either gates 91 or 92, respectively, to cause the N counter 57 to count up or down.

A phase-shift clock 95 supplies clock pulses at a rate higher than the output of the tachometer generator to the gates 91 and 92 under the direction of the M counter 56. The clock pulses are initiated by a single pulse from inverter 97 which presets the M counter 56 to a number determined by the M counter preset circuit 98. The M counter 56 includes two four bit binary counters 100 and 101, Fairchild type 9316. The clock 95 will therefore run until it is inhibited by the terminal count output of counter 101 which appears on line 105. During the period when the terminal count inhibits the clock, the preset from circuit 98 is held on the counter 101 until the next negative to positive input pulse from inverter 97 is received.

Thus, the M counter 56 will allow a predetermined number of clock pulses from each tach pulse output from the generator 30 to be applied to gates 91 and 92 and directed to the N counter 57, to cause that counter to count either up or down, depending upon the direction of rotation of the tachometer generator 30.

The N counter 57 supplies an output each time it receives a predetermined number of pulses, with this output being directed to the length counter 50, as previously explained. The N counter 57 is recycled after a predetermined number of pulses, regardless of whether it is counting up or down. This permits the conveyor to move in either direction without causing erroneous outputs from the tachometer prescaler circuit.

The N counter 57 includes three binary count integrated circuits 110, 111 and 112, each a National Semiconductor Corp. type DM8563 up-down binary counter, a preset circuit shown generally at 115, and comparator circuits or gates 117, 118 and 119, each a National Semiconductor Corp. type DM8200 four bit comparator. The binary counters 110–112 are used in supplying the down count, on line 121 while the gate circuits 117–119 through AND gate 123 and flip-flop 125 results in an up count on line 126 being applied to the length counter 50.

This circuit therefore enables the output pulses from the tachometer generator to be multiplied by the ratio M/N to provide a length measurement which may be calibrated in convenient units. Therefore a tachometer generator supplying output pulses representing any unit of length may be used and rotated in either direction and provided with the use of this invention an accurate and convenient indication of length measurement. Also, this type of circuit permits easy conversion from one unit of measurement to another, as for example, from inches to centimeters.

While the form of apparatus herein described constitutes a preferred embodiment of the invention, it is to be understood that the invention is not limited to this precise form of apparatus, and that changes may be made therein without departing from the scope of the invention which is defined in the appended claims.

What is claimed is:

1. Apparatus for converting pulses representing movement in one unit of measurement to pulses representing another unit of measurement, including means for generating pulses representing both distance and direction of movement, clock means for supplying clock pulses at a rate higher than the pulse rate of said pulse generating means, first and second adjustable counter means, means responsive to said first counter for supplying a predetermined number of clock pulses to said second counter for each pulse supplied by said pulse generating means, and gate means responsive to the pulse output of said pulse generating means for directing said predetermined number of pulses to cause said second counter to count either up or down, depending on the direction of movement of said pulse generating means, said second counter providing one of two outputs, depending upon the direction of movement of said pulse generating means, whenever the number of pulses supplied thereto obtains a predetermined value, whereby the output from said second counter means is determined by the pulses supplied from said pulse generating means as modified between ratio of the predetermined number preset into the first and second counter means.

2. The apparatus of claim 1 wherein said second counter means includes an up-down counter, said counter generating an output each time it down counts to zero, coincidence gates connected to the output of said up-down counter for generating an output each time said counter up counts to a predetermined number, and means for setting a preset number into said counter each time an output is generated by either said counter or said coincidence gates.

* * * * *